United States Patent [19]

Young

[11] 4,097,374

[45] Jun. 27, 1978

[54] SCREENING APPARATUS HYDROFOIL

[75] Inventor: Douglas Leonard Young, Lennoxville, Canada

[73] Assignee: Canadian Ingersoll-Rand Co. Ltd., Montreal, Canada

[21] Appl. No.: 762,475

[22] Filed: Jan. 26, 1977

[51] Int. Cl.[2] ..... B07B 1/52

[52] U.S. Cl. ..... 209/379

[58] Field of Search ..... 209/379, 273, 306, 284–287, 209/289, 270; 210/415

[56] References Cited

U.S. PATENT DOCUMENTS

| | | | |
|---|---|---|---|
| 3,029,951 | 4/1962 | Cannon | 210/415 |
| 3,261,468 | 7/1966 | Dick | 210/415 |
| 3,953,325 | 4/1976 | Nelson | 210/415 |

*Primary Examiner*—William A. Cuchlinski, Jr.
*Assistant Examiner*—Jon Hokanson
*Attorney, Agent, or Firm*—Frank S. Troidl

[57] ABSTRACT

This is a new hydrofoil structure. The hydrofoil has a radial outer surface having a circumferentially curved portion conforming to and closely spaced from the inside surface of the screen plate. The hydrofoil's radial outer surface also has a flat surface radially inward from the curved portion.

The radial outer surface of the hydrofoil is constructed to convey along the flat surface any particles or knots which get in the space between the flat surface and the inner surface of the screen plate.

4 Claims, 7 Drawing Figures

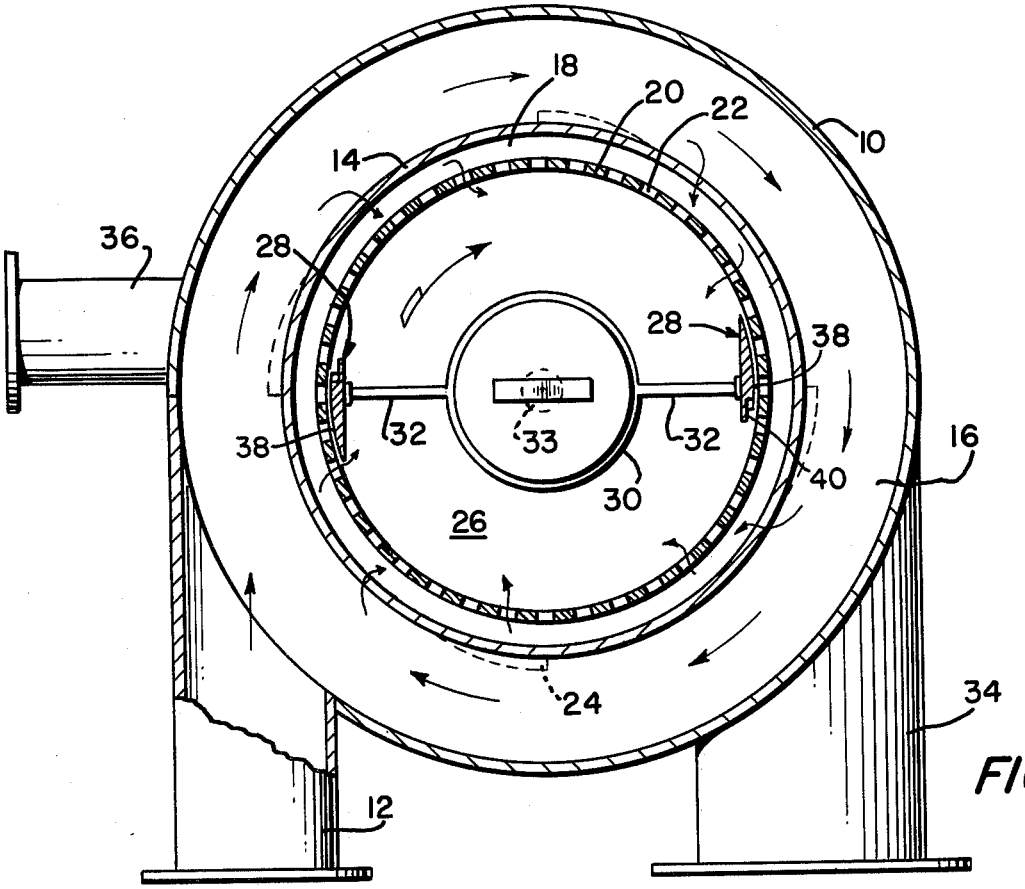
FIG. 1
FIG. 2
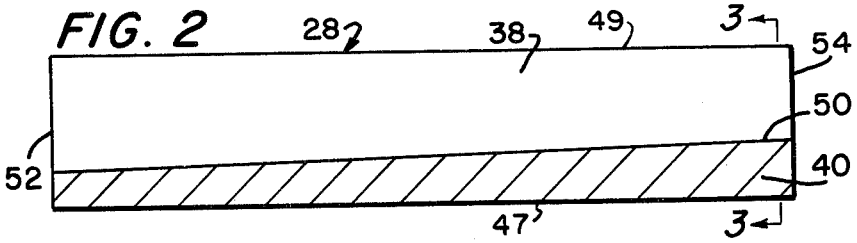
FIG. 3
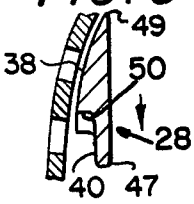
FIG. 4
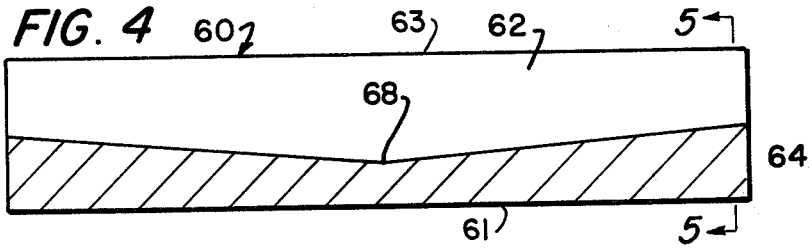
FIG. 5
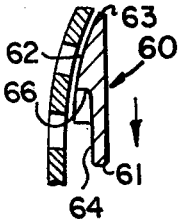
FIG. 6
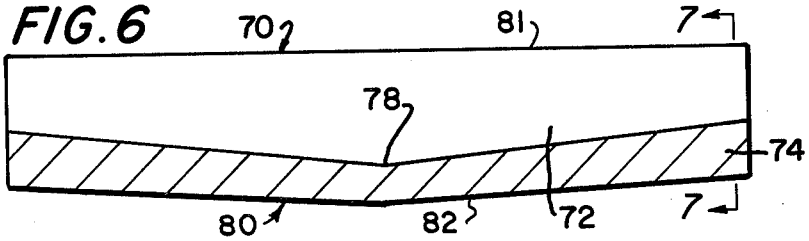
FIG. 7
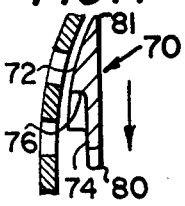

SCREENING APPARATUS HYDROFOIL

This invention relates to separators or screens for removing contaminants from a solid and liquid suspension. More particularly, this invention is a new and improved hydrofoil for use in separators or screens.

In certain processes, such as processes for removing undefibered chips and other contaminants from pulp or for removing traces of dirt, slivers, pitch and other contaminants from paper stock, a screen is included at the proper stage of the process to at least partially remove the undesired contaminants.

In some currently used apparatus for removing contaminants, an apertured screen plate is included as an important part of the apparatus. The size and shape of the apertures are determined by the size and shape of contaminants to be removed. In general, the apertures are larger in an apparatus used following a pulp making process for removing knots and other large materials than the size of the apertures, for example, in an apparatus used as a stage in a paper making process for removing smaller contaminants from the process than are removed following the pulp making process.

One problem is that the fibers and the contaminants tend to clog the apertures in the screen plate. Hydrofoils, rotatably mounted close to the apertures, have been used to generate hydraulic pulses in attempts to prevent the apertures from clogging. The clogging of the apertures, since the separator is part of a process operated under hydraulic pressure, causes undesirable instability in the operation of the process and creates high differential pressure across the screen, resulting in an uncontrolled and decreased throughput rate.

This invention is a new hydrofoil structure for keeping the apertures in the screen plate open. The structure and arrangement is such that less horsepower is required than required by other separators with hydrofoils under the same conditions.

Briefly described, this new invention includes a hydrofoil which may be rotated in a close radially spaced separation from the inside of the screen plate. The hydrofoil includes a radial outer surface comprising a circumferentially curved portion of the same shape as the inside surface of the screen and a substantially flat surface radially inward from the curved portion. A wall interconnects the curved portion and the substantially flat portion.

For cleaning a screen plate by a hydrofoil located on the accepts side, the hydrofoil must create a mass flow surge through the apertures in the direction opposing normal flow. This flow is caused by a positive pressure pulse. In addition, a conventional hydrofoil generates a second mass flow surge or negative pulse in the normal flow direction. This negative pulse is inherently undesirable as it may draw back into the apertures material previously ejected by the positive pulse, thus contributing to repeated clogging of the apertures. In this invention, the circumferential curved radial outer surface acts as a valve member, preventing development of the negative mass flow surge. Thus, this invention provides inherently improved operating stability and capacity compared with a conventional hydrofoil.

The invention as well as its many advantages may be further understood by reference to the following detailed description and drawings in which:

FIG. 1 is a plan view, partly in section, showing one embodiment of the new hydrofoil used in a screening apparatus forming a stage of a pulp making process;

FIG. 2 shows the radial outside structure of the hydrofoils shown in FIG. 1;

FIG. 3 is a view taken along lines 3—3 of FIG. 2 in the direction of the arrows with a portion of the screen plate excluded to show the direction of rotation of the hydrofoil shown in FIG. 3;

FIG. 4 is a view of the radial outside surface of a second hydrofoil embodiment;

FIG. 5 is a view taken along lines 5—5 of FIG. 4 and in the direction of the arrows with a portion of the screen plate included to show the direction of rotation of the hydrofoil shown in FIG. 4;

FIG. 6 is a view of the outside radial surface of still another hydrofoil embodiment; and FIG. 7 is a view taken along lines 7—7 of FIG. 6 and in the direction of the arrows with a portion of the screen plate included to show the direction of rotation of the hydrofoil shown in FIG. 6;

Referring to the drawings, and more particularly to FIG. 1, the screening apparatus shown is used to remove undefibered chips and other contaminants from pulp and includes a housing 10 which is provided with a wood pulp suspension inlet 12. A dilution liquid inlet (not shown) is provided for feeding a dilution liquid into the housing 10.

A cylindrical wall 14 of smaller diameter than the diameter of the housing 10 forms an annular chamber 16 with the inside of housing 10. The wood pulp suspension is fed through the inlet 12 into the annular chamber 16 and flows in the direction of the arrows. The wood pulp suspension also flows over the top of the cylindrical wall 14 and then downwardly through the annular channel 18 formed by the inside wall of cylindrical wall 14 and the outside wall of the screen plate 20 containing apertures 22.

The cylindrical wall 14 is provided with a plurality of spaced dilution liquid ports 24. There are four sets of spaced ports separated approximately 90°.

An inner chamber 26 is formed by the fixed cylindrical screen plate 20. Rotatable hydrofoils 28 circumferentially separated by an approximate 180° arc are coaxial with the screen plate 20. The hydrofoils 28 are mounted on a rotor 30 by means of connections 32. The rotor 30 may be rotated by conventional means, such as a motor driven belt (not shown), extending around a pulley (not shown) connected to the bottom of a shaft 33 which extends through the bottom of housing 10.

A maximum amount of desirable fibers flows through the apertures 22 in plate 20 into the inner chamber 26 and out of the housing 10 through the accepts outlet 34. A maximum amount of contaminants do not pass through the apertures 22 in screen plate 20, but rather flow downwardly in annular channel 18 and out of the housing 10 through rejects outlet 36.

A more detailed description of the thus far described parts of the screening apparatus of FIG. 1 may be found by referring to my U.S. Pat. No. 4,067,800 in the name of Douglas L. G. Young entitled "Screening Apparatus".

Contaminants as well as desirable fibers have a tendency to clog the apertures 22 in screen plate 20. The clogging of the apertures, of course, creates instability in the hydraulic pressure not only within the housing 10 itself, but also in the entire pulp processing system.

The rotatable hydrofoils 28 create pulses which are directed radially outwardly as the hydrofoils 28 pass by apertures 22. The outward pulses occur when the flat surface 40 of the hydrofoil 28 passes by an aperture 22. Thus, as each hydrofoil 28 passes around the inside surface of the fixed screen plate 20, the radially outward directed pulse will unclog any material which has clogged the apertures 22.

The separation of the curved surface 38 of hydrofoil 28 is kept very small, say, in a range of 0.030 inches to 0.045 inches in order to minimize the possibility of any material becoming wedged between the surface 38 and the inside surface of the fixed screen plate 20. The material of the hydrofoils 28 should be a wear resistent material to prevent unwanted rounding of the edges of the hydrofoil. The inside of the screen plate 20 should be specially prepared, such as by carefully machining the screen cylinder bore so that there are minimum variations in the inside diameter of the screen plate 20, thus providing a constant spacing between the curved surface 38 of the hydrofoil 28 and the inside surface of the screen plate 20 as the hydrofoils rotate close to the inside circumference of the screen plate 20.

The radial outside surface of the hydrofoil 28 is specially constructed so that a longitudinal pumping action of any material which gets between the flat surface 40 and the inside of the screen plate 20 occurs. This pumping action conveys the material downwardly toward the accepts outlet 34 and thus prevents the wedging of material in the space between the flat surface 40 and the inside of screen plate 20.

The structure of the hydrofoil 28 of FIG. 1 is shown in more detail in FIG. 2 and FIG. 3. Referring to these Figures, the hydrofoil 28 comprises a leading edge 47, a trailing edge 49 and a wall 50 which interconnects the curved surface 38 with the radially inwardly located flat surface 40 extending to the leading edge 47. The curved surface 38 tapers from the bottom 52 of hydrofoil 28 to the top 54. Thus, any material which gets in the space between the flat surface 40 and the inside of the fixed screen plate shown in FIG. 1 will be pumped along the wall 50.

A second embodiment of the invention is shown in FIG. 4 and FIG. 5. Referring to these figures, the hydrofoil 60 includes a leading edge 61, a trailing edge 63; a radial outer surface comprising curved surface 62 and a flat surface 64 located radially inwardly from the curved surface 62. The flat surface extends to the leading edge 61. The interconnecting wall 66 is shaped such that the curved surface 62 tapers from the longitudinal midpoint 68 of the hydrofoil 60 toward each end of the hydrofoil 60. As with the embodiment shown in FIG. 2 and FIG. 3, any material located in the space between flat surface 64 and the inside of the screen plate 20 is pumped along the wall 66.

A third and preferred embodiment is shown in FIG. 6 and FIG. 7. As shown in these figures, the hydrofoil 70 includes a leading edge 80, a trailing edge 81 the curved surface 72 on the radial outside of the hydrofoil 70 and the flat surface 74 on the radial outside of the hydrofoil with the surfaces 72 and 74 interconnected by the interconnecting wall 76. The flat surface 74 extends to the leading edge 80. As in the embodiment shown in FIG. 4 and FIG. 5, the embodiment shown in FIG. 6 and FIG. 7 has the curved surface 72 tapering from its longitudinal midpoint 78 toward each end of the hydrofoil 70. In the preferred embodiment of FIG. 6 and FIG. 7, however, the width of the hydrofoil 70 also tapers from the longitudinal midpoint 82 of the leading edge 80 toward each end of the hydrofoil 70. As with the other two embodiments, any material in the space between the flat surface 74 and the inside of the screen plate 20 is pumped along the wall 76.

The new hydrofoil described herein has been described in connection with its use in the coarse screen separator shown in FIG. 1, often called a "knotter". However, it is to be clearly understood that this new hydrofoil may also be used to unclog the apertures of screen plates used in other stages of a pulp or paper making process. For example, these hydrofoils may also be used to unclog material from a screening apparatus located just before the fourdrinier machines in a paper making system.

I claim:

1. In combination with a screening apparatus for screening a liquid suspension containing desirable fiber and undersirable contaminants: a cylindrical screen plate having a curved outer feed surface and a radially inner accepts surface and adapted to prevent contaminants from going through the screen plate while passing acceptable fibers; at least one rotatable element positioned adjacent said inner accepts surface; said element having a leading edge, a trailing edge, and a radial outer surface comprising a circumferentially curved portion conforming to the inner accepts surface of the screen plate, and a substantially flat surface on said radial outer surface and radially inward from said curved portion, said curved portion and said substantially flat portion being interconnected by a wall and said substantially flat surface extending to the leading edge of the element; and means for rotating the element in a position close enough to the inner accepts surface of the screen plate to minimize the possibility of fibers or contaminants wedging between the curved portion of the element and the screen plate.

2. The combination of claim 1 wherein the curved portion tapers from the bottom to the top.

3. The combination of claim 1 wherein the curved portion tapers from the longitudinal midpoint of the rotatable element to the top of the element and tapers from the longitudinal midpoint of the rotatable element to the bottom of the element.

4. The combination of claim 3 wherein the width of the element tapers from the longitudinal midpoint of the rotatable element to the top of the element and tapers from the longitudinal midpoint of the rotatable element to the bottom of the element.

* * * * *